United States Patent [19]

Hirata

[11] 4,141,292

[45] Feb. 27, 1979

[54] STENCIL HAND STAMP WITH SLIDING COVER

[75] Inventor: Hisashi Hirata, Tokyo, Japan

[73] Assignee: Kabushiki Kaisha Maruki Shokai, Tokyo, Japan

[21] Appl. No.: 851,960

[22] Filed: Nov. 16, 1977

[30] Foreign Application Priority Data

Dec. 9, 1976 [JP] Japan ..... 51-164111[U]

[51] Int. Cl.[2] ..... B41F 15/02; B41L 27/26

[52] U.S. Cl. ..... 101/125

[58] Field of Search ..... 101/125, 405

[56] References Cited

U.S. PATENT DOCUMENTS

| | | | |
|---|---|---|---|
| 1,582,004 | 4/1926 | Griggs | 101/125 |
| 1,592,194 | 7/1926 | Ferriss | 101/125 |
| 3,752,071 | 8/1973 | McKay | 101/125 |

FOREIGN PATENT DOCUMENTS

| | | | |
|---|---|---|---|
| 240815 | 7/1926 | United Kingdom | 101/125 |

*Primary Examiner*—Ronald E. Suter
*Attorney, Agent, or Firm*—Koda and Androlia

[57] ABSTRACT

A mimeograph device which comprises a rectangular framework having a center window, a closure plate slidably received in the framework and having a knob, a perforated plate convexed downwardly and attached to the undersurface of the framework to define an ink holding chamber in cooperation with the closure plate, an air-liquid permeable sponge sheet convexed downwardly and applied to the undersurface of the perforated plate and a screen convexed downwardly and applied to the undersurface of the sponge sheet for releasably receiving a stencil paper thereon.

1 Claim, 3 Drawing Figures

STENCIL HAND STAMP WITH SLIDING COVER

BACKGROUND OF THE INVENTION

This invention relates to improvements in mimeograph devices and more particularly, to a mimeograph device of the type which holds a predetermined amount of ink in the ink holding chamber defined therein and has a stencil paper bearing information comprising letters, numerals and/or symbols cut thereon applied to the air-ink permeable assembly so as to print the information on an article.

There have been proposed and practically employed a great variety of mimeograph devices and one of the prior art mimeograph device is shown in FIG. 1 of the accompanying drawings. The prior art mimeograph device generally comprises a rectangular support frame 1 having a pair of side legs 2,2 and a pair of end legs (not shown) which integrally depend from the undersurface of the frame in positions adjacent to and inwardly spaced from the associated side and end edges thereof, respectively and a center through hole 3 for the purpose to be described hereinafter. A perforated ink holding plate 4 having a U-shaped cross-section as seen in end elevation is held in position on the undersurface of the support frame 1 with the opposite upright side arms 5,5 and opposite upright end arms (not shown) of the plate suitably attached to the undersurface of the support frame 1 and the intermediate portion 6 convexed downwardly to thereby define an ink holding chamber 7 between the support frame and perforated plate. An air and liquid permeable resilient member 8 formed of sponge is applied to the outer surface or undersurface of the perforated plate 4 and a screen 9 is applied to the outer surface or undersurface of the sponge member and the screen may be formed of a piece of cloth, for example. A mimeograph original such as a stencil paper 10 having information comprising letters, numerals and/or symbols cut thereon is applied to the outer surface or undersurface of the screen 9. A hollow knob 11 is received and held in position in the center through hole 3 in the support frame 1 and the knob has spaced upper and lower brackets 12, 13 adjacent to the lower end of the knob which brackets are snugly fitted on the periphery defining the center through hole 3. The low bracket 13 is provided with a hole (not shown) and the support frame 1 also has a hole (not shown) which is adapted to communicate with the hole in the lower bracket when ink is to be charged into the ink holding chamber 7 as the knob 11 is turned so as to align the hole in the lower bracket 13 with the hole in the support frame 1. With the above-mentioned arrangement, when it is desired to print the information of the stencil paper 10 on a sheet of paper (not shown), for example, the user grips the knob 11 and applies the stencil paper 10 against the paper sheet with a slight pressure whereby the ink in the ink holding chamber 4 is permitted to permeate through the perforated plate 4, sponge 8, screen 9 and the cut information on the stencil paper 10 under pressure and the information is printed on the paper sheet.

However, in the prior art mimeograph device referred to hereinabove, since the through hole 3 in the support frame 1 in which the knob 11 is received also serves as the ink charging port, if the effective area of the perforated plate 4 is formed with a large size, it takes a rather long time for the ink which is usually of high viscosity to spread across the overall effective area of the perforated plate 4. And since the ink is charged into the ink holding chamber at only one area of the chamber or more particularly, through the center through hole 3 in the support frame 1 via the aligned holes in the bracket and frame, the stencil paper 10 receives more ink at its center area than the paper does at the rest of the paper resulting in uneven distribution of ink across the stencil paper and thus, a satisfactory printing result cannot be obtained.

SUMMARY OF THE INVENTION

Therefore, one object of the present invention is to provide a novel and improved mimeograph device which can effectively eliminate the disadvantage inherent in the prior art mimeograph device referred to hereinabove.

Another object of the present invention is to provide a novel and improved mimeograph device which can distribute the ink evenly over the entire effective area of the stencil paper to thereby obtain a high quality printing product.

According to the present invention, there has been provided a mimeograph device which comprises a rectangular support framework, a perforated plate convexed downdardly and attached to the undersurface of the support member, an air-liquid permeable resilient sheet such as a sponge sheet applied to the undersurface of the perforated plate to define an ink holding chamber therebetween, a screen applied to the undersurface of the air-liquid permeable sheet and a stencil paper releasably applied to the undersurface of the screen and bearing information comprising letters, numerals and/or symbols cut thereon, characterized by that the support framework comprises a pair of opposite and spaced longer side frames having longitudinal notches in the opposite inner faces and a shorter end frame integrally connected at the opposite ends to the adjacent ends of the longer side frames and having a notch in the inner surface to define a rectangular window in the center of the support framework and a rectangular closure plate slidably received at the opposite side edges and one end edge in the notches in the longer side and shorter end frames of the support framework and having a knob attached to and extending uprightly from the closure plate.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 2:
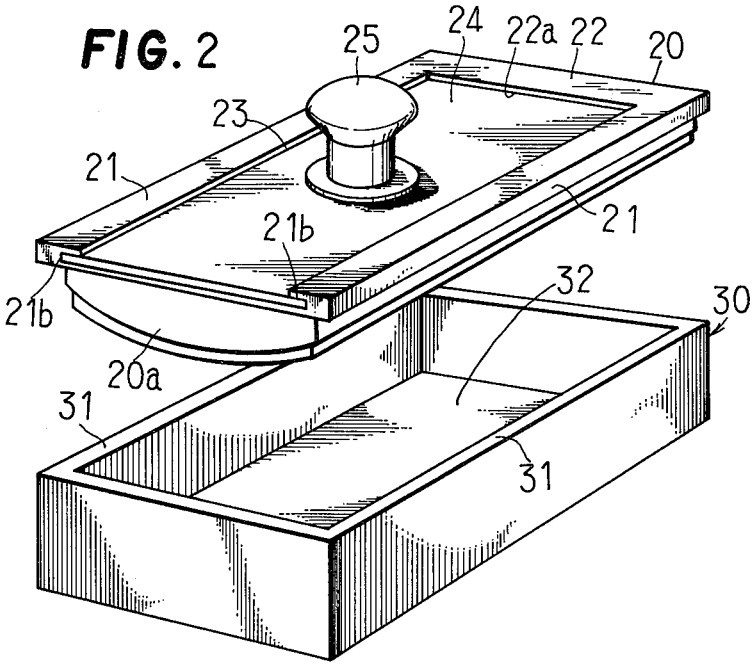
FIG. 2 is an exploded perspective view of one preferred embodiment of a mimeograph device constructed in accordance with the principle of the present invention.
Figure 3:
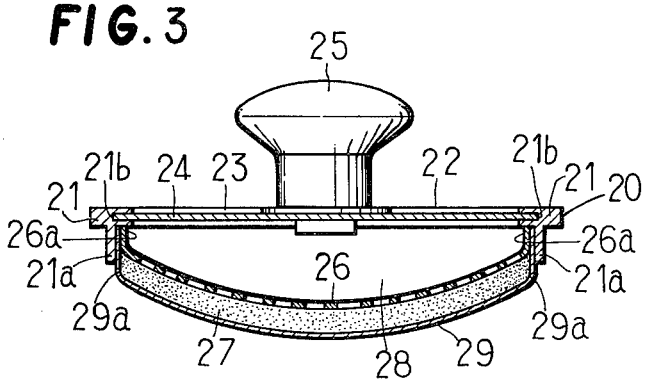
FIG. 3 is an end elevational view in vertical section of said mimeograph device as shown in FIG. 2.

The present invention will now be described referring to FIGS. 2 and 3 of the accompanying drawings which show one preferred embodiment of the invention for illustration purpose only, but not for limiting the scope of the same in any way. The mimeograph device of the invention generally comprises a rectangular support framework 20 which includes a pair of opposite and spaced longer side frame members 21, 21 and a shorter end frame member 22 integrally connected at the opposite ends to the adjacent ends of the longer side frame members to define a rectangular window or opening 23 therebetween. Each of the side frame members 21, 21 has a leg 21a, depending from the undersurface of the member and a notch 21b in the inner surface extending along the length of the associated side member. The end frame member 22 also has a notch 22*a* in the inner surface extending along the length of the associated frame member. The side frame members 21, 21 are connected together in their lower portions at the ends remote from the end frame member 22. The support framework also has on the undersurface downwardly extending end legs 20*a*, 20*a* (only one end leg 20*a* is shown in FIG. 2) at the opposite ends thereof. A window closure plate 24 is slidably received at the opposite sides edges and one end edge in the notches 21*b*, 21*b* in the longer side frame members 21, 21 and in the notch 22*a* in the end frame member 22, respectively and has a knob 25 extending upwardly from the upper surface of the closure plate. A substantially U-shaped cross-section perforated plate 26 convexed downwardly is attached at the opposite upright arms 26*a*, 26*a* and end arms (not shown) to the undersurface of the support framework 20. An air-liquid permeable resilient sheet 27 formed of sponge and having a substantially U-shaped cross-section for example, is applied to the undersurface of the perforated plate 26 to define an ink holding chamber 28 in cooperation with the closure plate 24.

Figure 1:
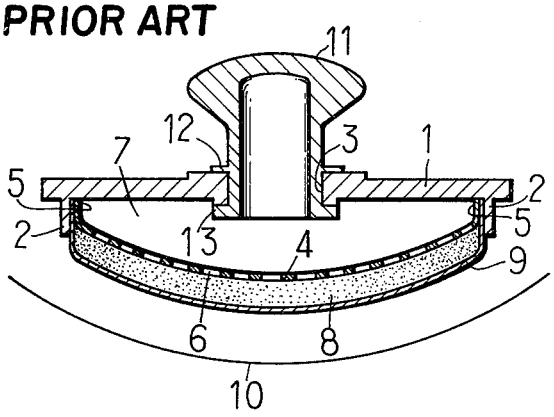
FIG. 1 PRIOR ART
FIG. 1 is an end elevational view in vertical section of one prior art mimeograph device.

A screen 29 formed of cloth is applied to the undersurface of the air-liquid permeable resilient sponge member 27 with the opposite upright arms 29*a*, 29*a* and opposite upright end arms (not shown) pinched between the legs 21a, 21a, and legs 20*a* 20*a* of the framework 20 and the side arms 26*a*, 26*a* and end arms of the perforated plate 26, respectively. In operation, a stencil paper (not shown) having information comprising letters, numerals and/or symbols cut thereon is applied to the undersurface of the screen 29 and thereafter, the printing operation is performed as described hereinabove in connection with the prior art mimeograph device of FIG. 1. In FIG. 2, reference numeral 30 denotes a storage casing for receiving the mimeograph device when the device is not used. The storage casing 30 is so dimensioned and shaped that when the mimeograph device is received therein, the side edges or side frame members 21, 21 of the framework 20 rest on the side walls 31, 31 of the casing and the screen 29 is maintained spaced from the bottom 32 of the casing.

With the above construction and arrangement of the parts of the mimeograph device of the invention, by the provision of the window 23 in the framework 20 and the slidable closure plate 24, since the ink holding chamber 28 can be opened wide with the closure plate 24 in its open position when the ink is charged into the ink holding chamber so that the charged ink can be easily and rapidly spreaded over the entire effective ink receiving area of the stencil paper with uniformity and therefore, even when the mimeograph device is constructed with a large size to be employed with a stencil paper having a large effective area, a high quality print can be obtained.

While only one embodiment of the invention has been shown and described in detail, it will be understood that the same is for illustration purpose only and not to be taken as a definition of the invention, reference being had for this purpose to the appended claims.

What is claimed is:

1. An improvement in a mimeograph device wherein said mimeograph device has a rectangular support framework, a perforated plate convexed downwardly and applied to the undersurface of said support framework to define an ink holding chamber, an air and liquid permeable sponge member convexed downwardly and applied to the undersurface of said perforated plate and a screen convexed downwardly and applied to the undersurface of said sponge member for receiving a stencil paper on the undersurface of said screen, said improvement comprising:

a window closure plate slidably recieved in said support framework; and wherein said support framework is integrally formed of a pair of opposite side frame members and a single end frame member integrally connected at opposite ends to the adjacent ends of said pair of side frame members to define a center window within the center of said support framework, and wherein each said side and end frame member has a continuous groove inscribed in the inner surfaces for slidably receiving said closure plate, said closure plate having attached thereto an upright knob and wherein said support framework further integrally comprises continuous downwardly extending sides to form a closed rectangular frame beneath said closure plate wherein said perforated plate and said screen each has peripheral portions disposed upwardly and inwardly with respect to said frame formed by said downwardly extending sides, said peripheral portions of said perforated plate resiliently urging said peripheral portions of said screen tightly against the inner surfaces of said downwardly extending sides forming said frame to thereby retain said screen, whereby a mimeograph is formed from a single integral frame, having a minimum number of components to define said ink holding chamber, which ink holding chamber is readily accessible by a completely removable closure plate slidably fitted into said integral support framework thereby decreasing the complexity and cost of said mimeograph.

* * * * *